United States Patent [19]

Ohshima et al.

[11] Patent Number: 4,707,126

[45] Date of Patent: Nov. 17, 1987

[54] METHOD OF POSITIONING ORIGINAL IMAGE TO BE COPIED AND APPARATUS FOR PERFORMING THE SAME

[75] Inventors: Kiyoshi Ohshima; Shigeru Suzuki; Harumitsu Mashiko; Eisyu Ohdake, all of Yokohama, Japan

[73] Assignee: Ricoh Company, Ltd., Tokyo, Japan

[21] Appl. No.: 754,842

[22] Filed: Jul. 12, 1985

[30] Foreign Application Priority Data

| | | | |
|---|---|---|---|
| Jul. 13, 1984 | [JP] | Japan | 59-144138 |
| Jul. 20, 1984 | [JP] | Japan | 59-149307 |
| Jul. 21, 1984 | [JP] | Japan | 59-150482 |

[51] Int. Cl.[4] ..... G03G 15/00

[52] U.S. Cl. ..... 355/14 SH; 355/3 R; 355/14 R; 355/7; 355/5

[58] Field of Search ..... 355/3 R, 14 R, 14 E, 355/14 SH, 14 C, 60, 75, 7, 5

[56] References Cited

U.S. PATENT DOCUMENTS

| | | | |
|---|---|---|---|
| 4,260,248 | 4/1981 | Murata et al. | 355/60 |
| 4,346,982 | 8/1982 | Nakajima et al. | 355/3 R |
| 4,616,269 | 10/1986 | Mori | 355/7 X |

FOREIGN PATENT DOCUMENTS

| | | | |
|---|---|---|---|
| 59-87470A | 5/1984 | Japan | 355/14 E |

*Primary Examiner*—A. C. Prescott

*Attorney, Agent, or Firm*—Oblon, Fisher, Spivak, McClelland & Maier

[57] ABSTRACT

A composite copy of an image or images from a single or plural original sheets is formed by regulating the position or positions of the images from the original sheets on the copy sheet in a copy paper feeding direction and a direction orthogonal thereto. The setting of the image positions in the X and Y directions on the copy sheet is obtained by regulating the scanning of the original sheet, movement of the illumination system or optical system, or timing of movement of the photosensitive member or the copy sheet.

20 Claims, 24 Drawing Figures

FIG. 6E
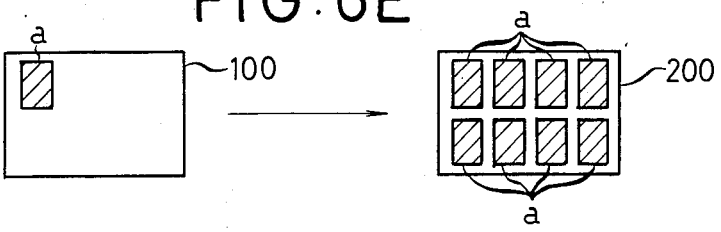
FIG. 6F
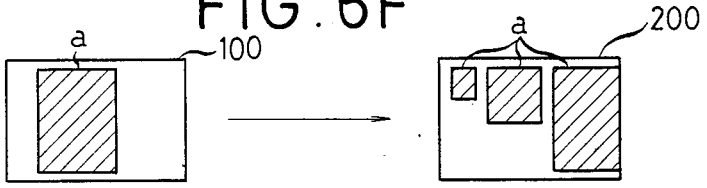
FIG. 6G
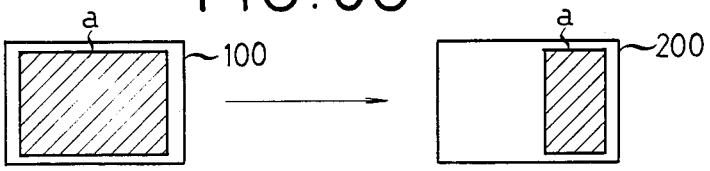
FIG. 8A
FIG. 8B
FIG. 8C
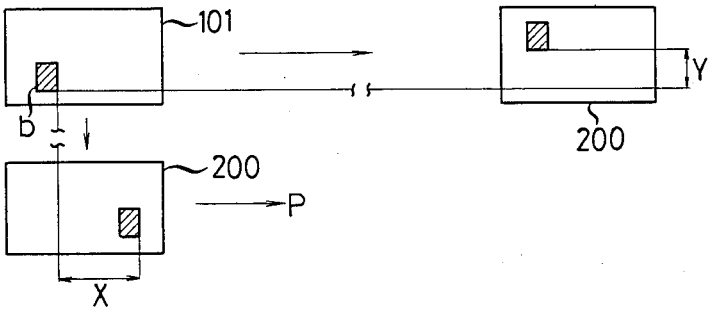

METHOD OF POSITIONING ORIGINAL IMAGE TO BE COPIED AND APPARATUS FOR PERFORMING THE SAME

BACKGROUND OF THE INVENTION

The present invention relates to a method of positioning an original image or images in s desired position or positions on a copy paper in a copying machine during a copying operation of the latter and an apparatus performing the same.

A copying machine, in which an original paper is illuminated by an illumination device supported movably relative to the original paper to expose a photosensitive member with an image on the original paper to thereby form an electrostatic latent image of the original image thereon, the latent image thus formed is developed by toner to form a visual image and then the latter is transferred to a copying paper, has been known.

In copying an original paper or papers by such copying machine, it is desirable, in some case, to arbitrarily set a position or positions of an image (or images) on a copy paper regardless of its position (or positions) on the original paper (or papers). This is particularly true when image portions on a single or plural original sheets are to be composed on the single copying paper. However, there have been no means provided in such copying machine, which can perform such function.

SUMMARY OF THE INVENTION

An object of the present invention is to provide a method of arbitrarily changing a position (or positions) of an image portion (or portions) on a copy paper in a first direction along which the copy paper is transported toward a photosensitive member and or a second direction orthogonal to the first direction, regardless of the position (or positions of the images) on an original paper (or papers) to be copied.

Another object of the present invention is to provide a copying machine in which image portions on a single original sheet can be copied on a single copying machine paper with the relative positions of the image portions on the copying paper being selectively changed and in which editing of images on the copying paper can be performed.

These objects can be achieved, according to the present invention, by regulating the position of the image of the orignal sheet by means of a position setting means in a copy paper feeding direction to the photosensitive member and a direction orthogonal to the copy paper feeding direction on the copy paper.

BRIEF DESCRIPTION OF THE DRAWING

FIGS. 6A to 6G illustrate examples of a composite copy of images of a single original sheet;

FIGS. 8A, 8B and 8C illustrate a shifting of an original image on a copy paper;

DESCRIPTION OF PREFERRED EMBODIMENTS

Figure 1:
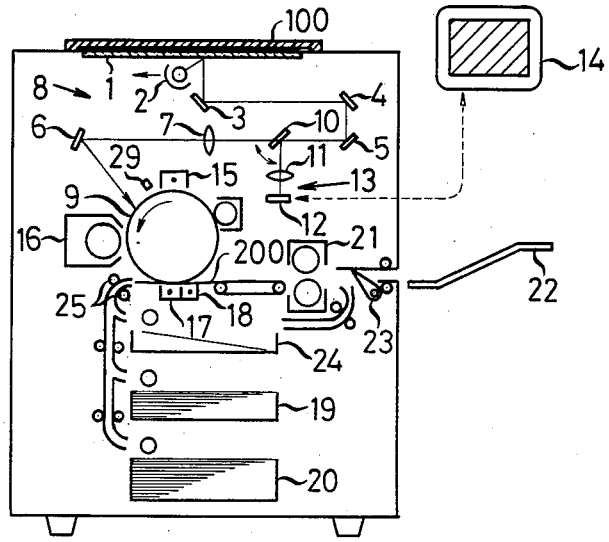
FIG. 1 shows, schematically, an embodiment of a copying machine according to the present invention.

In FIG. 1, an original sheet 100 is disposed on an original sheet mounting plate 1, a such as, contact glass, and scanned optically by an illuminating device 2 which is movable along a direction shown by the arrow. Reflected light from the original sheet 100 is directed through a first optical system 8 composed of mirrors 3, 4, 5 and 6 and a condensing lens 7 to a photosensitive member or drum 9 to focus an image of the original sheet 100 thereon. Alternatively, it may be possible to deflect the reflected light by a switch-over mirror 10 swingably provided in the first optical system 8 before it reaches the condensing lens 7 to focus the image on a photoelectric conversion means such as a linear array of a charge coupled device (CCD)12, through a lens 11. In the latter case, the switch-over mirror 10, the lens 11 and the CCD array 12 constitute a second optical system 13 for converting the images into electric signals. A display unit 14 such as CRT or a digital image display device composed of liquid crystal elements etc. may be provided to display the image according to the output electric signal from the second optical system 13.

The photosensitive drum 9 has a surface uniformly charged electrostatically by a charger 15 and, when the original image is focused thereon by means of the first optical system 8, an electrostatic latent image is formed. The latent image on the photosensitive drum 9 is developed by suppplying toner through a developing device 16 and the developed image is transferred, by a transfer charger 17, to a copy sheet 200 fed from either an upper paper feeding portion 19 or a lower paper feeding portion 20. The copy paper onto which the developed image is transferred is separated from the photosensitive drum 9 by a separating charger 18 and, after the image is fixed by a fixing device 21, discharged to an ejection tray 22.

In order to form a composite image, the copy paper 200 is passed through a branch guide device 23 such as a swingable guide member after the developed image is transferred thereto and fixed thereon and guided to a buffer tray 24 in which it is stored temporarily. Then, a second, third and subsequent images are transferred onto the copy paper 200 sent out again from the buffer tray 24 and fixed thereon repeatedly in the same manner, resulting in a composite image on the copy paper which is a combination of the first, second, third and subsequent original images.

Figure 2:
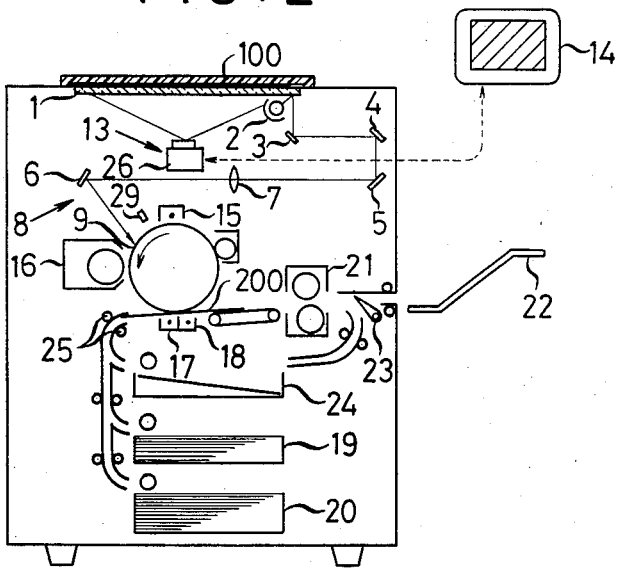
FIGS. 2 to 4 show, schematically, other embodiments of the present invention, respectively.

FIG. 2 shows another embodiment of the present invention, in which the second optical system 13 in FIG. 1 is replaced by a video camera 26 (or a combination of an illumination device and a two-dimensional array of CCDs) which functions to scan the images of the original sheet mounted on the original mounting plate 1. With this embodiment, it becomes possible to display the images on the display device on a realtime basis.

Figure 3:
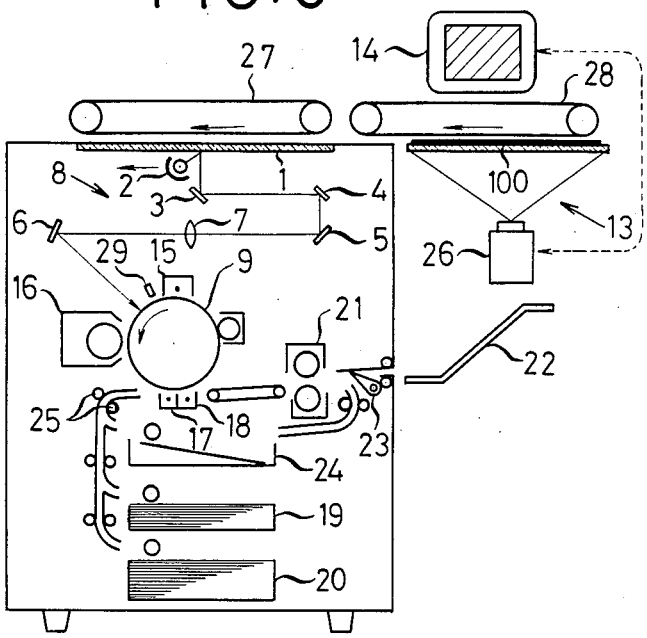

FIG. 3 shows another embodiment of the present invention, which is provided with a semi or fully automatic original sheet transporting device 27, in addition to a first optical system 8 which is similar to that shown in FIG. 1, and is constituted such that an original sheet 100 is sent, by a pre-feeding device 28, to a region in which it is readout by a video camera 26 or the like of the second optical system 13 disposed to one side of the original sheet inlet formed in a side portion of the copying machine, prior to feeding of the original sheet by the automatic feeding device 27 onto the original sheet mounting plate 1. That is, the original sheet is first readout by the second optical system 13 and then scanned by the first optical system 8. The remaining portions of the copying machine shown in FIG. 3 are the same as those shown in FIG. 1 and details thereof are not repeated.

Figure 4:
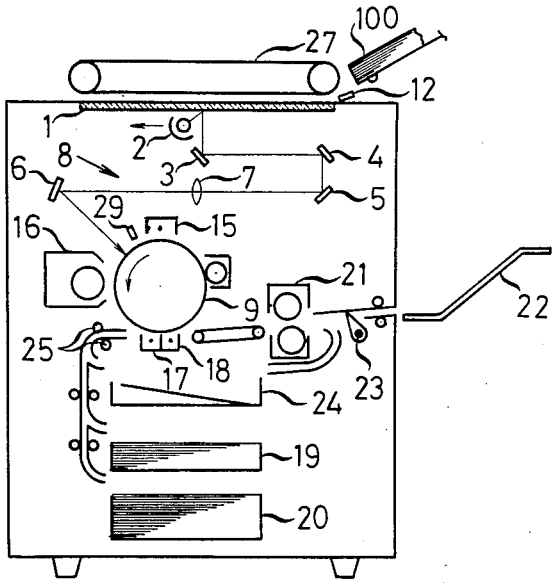

FIG. 4 is another embodiment of the present invention in which a linear array of CCDs 12 is disposed beneath the original sheet inlet passage of the automatic feeding device 27 shown in FIG. 3 to readout the images of the original sheet 100 fed to the automatic feeding device 27.

Examples of a composition copying operation of any of the copying machines shown in FIGS. 1 to 4 will be described with reference to FIGS. 5A to 5C in which images of 2 or more original sheets are composed.

Figure 5A:
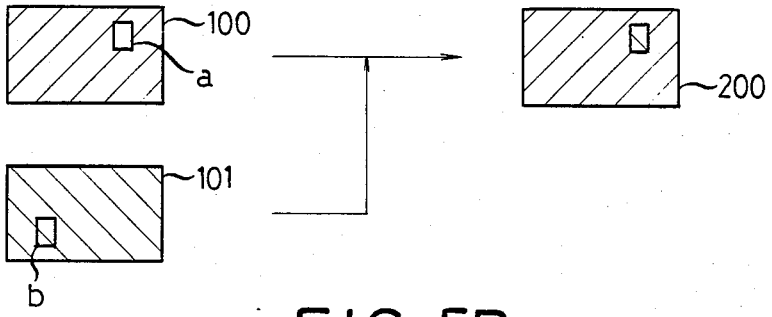
FIGS. 5A to 5C illustrate examples of a composite copy of images of a plurality of original sheets, respectively.

In FIG. 5A, a portion a of a first original sheet 100 is erased and, instead thereof, a portion b of a second original sheet 101 is inserted therein after a suitable shifting operation for the portion b to form a composite copy 200. When the portion a is blank originally, the erasing operation becomes unnecessary. In this case, the portion b may be enlarged or reduced according to demand.

Figure 5B:
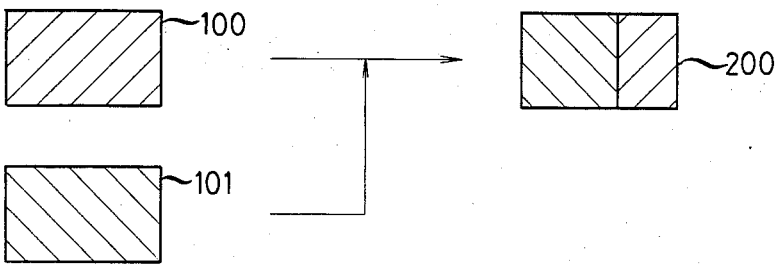

In FIG. 5B, a left side image portion of the first original sheet 100 and a right side image portion of the second original sheet 101 are composed in juxtaposed relation to form a composite copy 200.

Figure 5C:
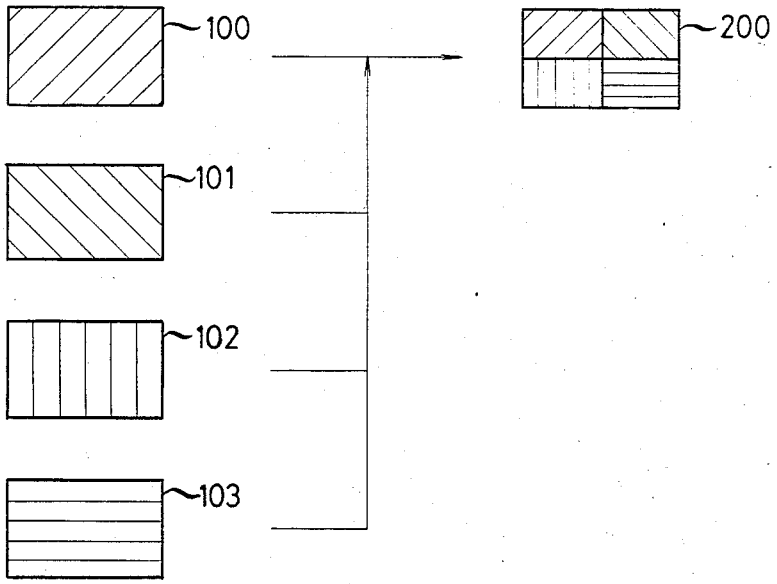

In FIG. 5C, image portions of four original sheets 100 to 103 are composed on a copy sheet 200.

These compositions are mere examples, of which a variety of compositions may be possible.

FIGS. 6A to 6G shows examples in which various image portions of single original sheet 100 are changed in position, or enlarged or reduced according to demand.

Figure 6A:
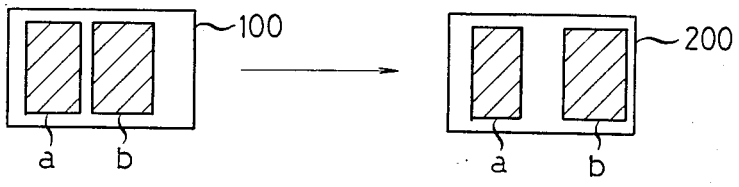
Figure 6B:
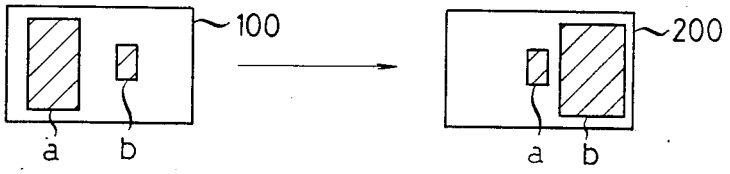
Figure 6C:
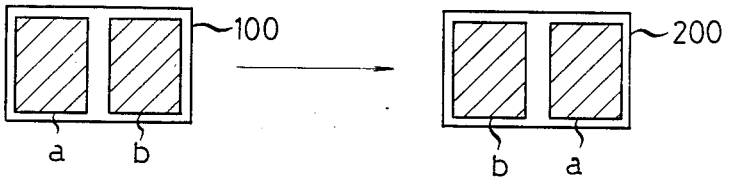
Figure 6D:
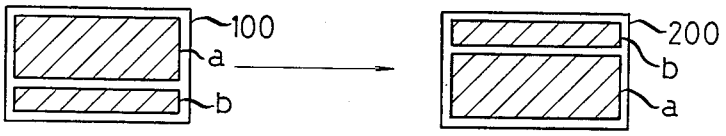

In FIG. 6A, portions a and b of the single original sheet 100 are changed in position. In FIG. 6B, the portion a is reduced and the portion b is enlarged with positions thereof being changed slightly. In FIG. 6C, the positions of the portions a and b are exchanged horizontally and, in FIG. 6D, the positions are exchanged vertically. In Fig. 6E, a plurality of the portions a are arranged on a copy sheet. In FIG. 6F, a plurality of the portions a are arranged with each being reduced differently, and, in FIG. 6G, the portion a is reduced and the position thereof is changed. Various other compositions may be easily provided.

The formation of a composite copy will be described for the composite copy shown in FIG. 5A as an example.

In the apparatus shown in FIG. 1, the first original sheet 100 on the original mounting plate 1 is preliminarily scanned by the illumination device 2 and then displayed on the display device 14 by means of the second optical system 13. On the display device 14, a magnification is selected, and the size and orientation of a copy sheet are superimposed on the displayed original image of the original sheet to confirm an area of the original image which can be copied on the copy sheet. With this display of the area available for copy, an identification of selecting conditions and a modification thereof become possible to thereby prevent any erroneous copying from occuring.

Any image portion of the available area, which is to be copied, is framed in or out by using a cursor provided on a screen of the display device or a light pen and copying conditions such as magnification and concentration etc. are input similarly.

These parameters selected for the first original 100 are stored in a memory, completing preparation for a copying operation.

In this preparation or simulation stage, the switchover mirror 10 is in the position shown and, in a copying operation, it is removed from the optical path so that the first optical system can be used.

Figure 7:
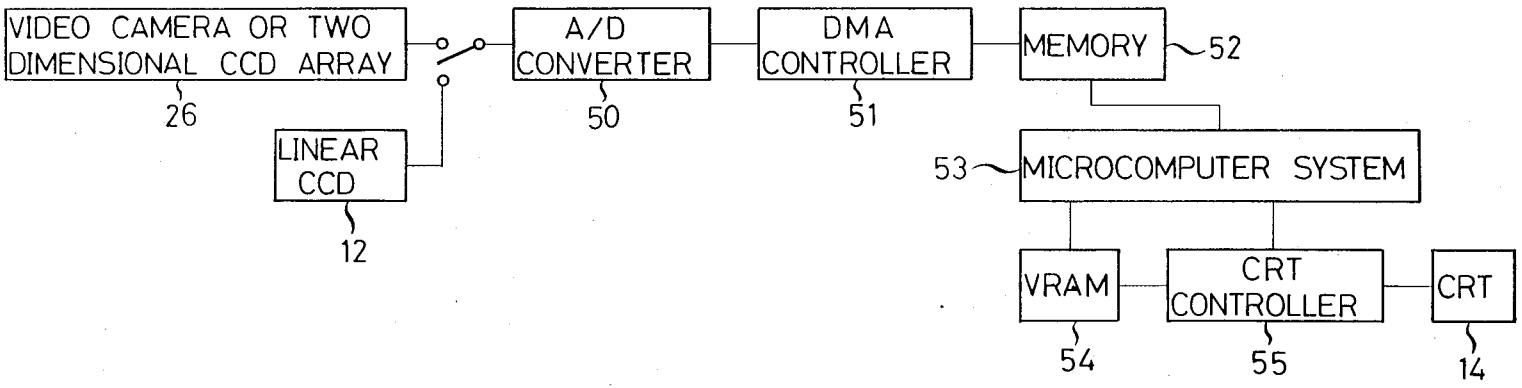
FIG. 7 is a block diagram showing a portion of a control unit.

FIG. 7 shows a control portion for selectively storing various copying conditions such as concentration etc. in simulating a composite copy. Although a linear array of CCDs12 and a video camera 26 (or two dimensional array of CCDs) are provided and either one is selectively used in FIG. 7, it may be possible to provide only the linear CCD array 12 as shown in FIG. 1 or 4 or only the video camera 26 (or two dimensional CCD array) as shown in FIG. 2 or 3.

Information from the second optical system is digitized by an A/D converter 50 and, after being processed by a DMA controller 51, stored in a memory 52. Digital information stored in the memory 52 are suitably processed by a microcomputer system 53. For example, information to be displayed on a display unit 14 comprising a CRT is stored in a VRAM 54 and, simultaneously, controlled by a CRT controller 55 for display on the display unit 14.

When a copy-start button is depressed, the copying process commences, upon which the illumination device 2 scans the original sheet on the original sheet mounting plate so that the image of the original sheet is focused on the photosensitive drum 9 rotating counterclockwise to form a latent image thereon which is developed by toner and transferred onto a copy sheet, as mentioned previously.

Since the relative position of the image displayed on the display unit is the same as that of the image to be transferred onto the copy sheet, it is possible to erase from the copy sheet a desired portion of the image by controlling at least one of the charger 15, the erase device 29, the developing device 16 and the transfer charger 17, according to instructions from the control portion storing the copying conditions.

For example, the erase device 29 may be constituted with a linear array of LEDs, each being on-off controllable independently. The erase device is arranged between the charger 15 and an exposing position determined by the first optical system 8 in a direction orthogonal to a moving or rotating direction of the photosensitive drum and is controlled to delete from the copy sheet a selected image portion, e.g., the portion a is erased in the example shown in FIG. 5A. With the rotation of the photosensitive drum 9 uniformly charged by the charger 15, the LEDs of the erase device 29 corresponding, in position, to both side edges of the original sheet in which no image portion exist are turned on to clear electric charge on these areas of the photosensitive drum 9.

When the portion a arrives at the erase device 29, the LEDs thereof which correspond, in position, to the portion a and the outside area of the image are turned on to the clear charges thereon. After the portion a passes through the erase device 29, only the LEDs thereof which correspond, in position, to the portion 2 are turned off, those corresponding to the outside area being kept unchanged.

Since the area of the photosensitive drum 9 in which the charges are removed by the erase device 29 has no image to be developed, the portion a of the image obtained on a copy sheet is blank.

The copy sheet onto which the image is transferred and fixed is stored in the buffer tray 24 by switching the passage changing guide 23. After the single or a desired number of copying operations for the first original sheet are completed, the second original sheet 101 (FIG. 5A) is set on the original sheet mounting plate 1, and the image is converted by the second optical system into electric signals and displayed on the display unit 14 in the same way as that for the first original sheet 100. A portion or portions of the image of the second original sheet 101 to be copied are determined similarly. Simultaneously with the image display of the second original sheet or according to a key instruction, a composite image of the area of the first original sheet which is stored in the memory and desired image portion or portions of the second original sheet are displayed on the display unit.

When the portion a, i.e., the area selected as the frame, of the first original sheet is different, in position, from the desired image portion b of the second original sheet as in the case of FIG. 5A, the position of the portion b is shifted on the display unit such that it coincides with the position of the portion a, and the amount of shift is stored in the memory. The size of the portion b is regulated by changing the magnification setting so that it fits in the frame a, the size of the latter being unchanged. Alternatively, it may be possible to regulate the size of the frame a while the size of the portion b is kept unchanged.

After the copying conditions of the second original sheet with respect to the first original sheet are set by a simulation on the display unit, the copy start button is depressed to start a copying operation of the second original sheet 101.

Each of the copy sheets stored in the buffer tray 24 is registered by register rollers 25 and sent to the transfer station in which a developed image is transferred from the photosensitive drum 9 to the copy sheet which is then sent to the fixing device 21 to fix the transferred image on the copy sheet and discharged to the receiving tray 22.

The shift of the portion b of the second original sheet to the position of the portion a of the first original sheet is performed according to the amount of shift obtained by the simulation on the display unit and stored in the memory. In the case of FIG. 5A, the image portion b of the original sheet 101 shown in FIG. 8A is shifted by a distance X in the moving direction P of the copying paper 200 to the photosensitive member as shown in FIG. 8B and by a distance Y in a direction orthogonal to the direction P, as shown in FIG. 8C.

Figure 9:
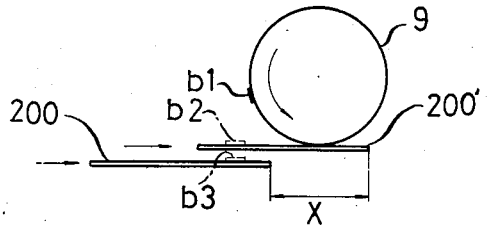
FIGS. 9 and 10 illustrate a shifting of an original image in a copy paper feeding direction.

The amount of shift of the image portion b in the X direction can be regulated by regulating a timing of commencement of rotation of the register roller 25 as shown in FIG. 9 in which the copying sheet which is to have the image portion b shifted is shown by 200 and the copying sheet which is to have the image portion b without shift is shown by 200'. That is, when the timing of commencement of rotation of the register roller 25 is selected such that the copying sheet 200 on which a visible image b1 formed on the photosensitive drum 9 is delayed by a distance X with respect to the copying sheet 200', the visible image b1 is transferred to the sheet 200 at a position b3 which is remote from a position b2 on the copy sheet 200'. By setting the timing forward, it is possible to shift the image transferring position in the opposite direction.

Figure 10:
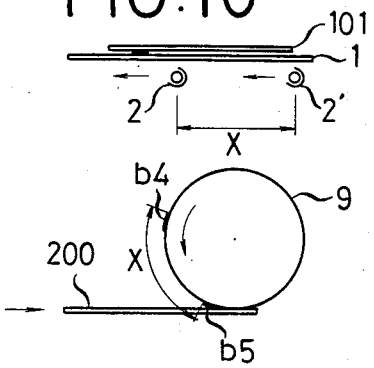
Figure 11:
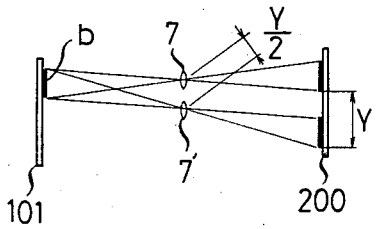
FIG. 11 illustrates a shifting of an original image in a direction orthogonal to the copy paper feeding direction.

If the original sheet mounting plate 1 is fixed and an original sheet 101 is illuminated, a point 2 at which an effective illumination of the sheet 101 is started by the illumination device is set forwardly of the normal point 2', at which no image portion shift is produced, by a distance X, while the timing of the rotation of the photosensitive drum and the copy sheet feeding is kept unchanged as shown in FIG. 10. By doing so, it is possible to form a visible image portion at a position b5 on the photosensitive drum 9 which is forwardly of the image formed at a position b4 when the illumination device is actuated at the position 2', by the distance X and thus it is possible to form the visible image in the position shown in FIG. 8B. Alternatively, it may be possible to change a timing of exposure commencement of the photosensitive drum by changing the timing of illumination commencement with respect to the photosensitive drum and the copying sheet without changing the starting position of the illumination device operation. That is, by starting an illumination of the original sheet at a time which is earlier than that used to form a visible image without shift, it is possible to form a visible image in the position b5 as in the same manner as shown in FIG. 10 and thus to obtain the copy sheet 200 shown in FIG. 8B.

When the original sheet is illuminated while the original sheet mounting plate 1 is being moved, the same effect can be obtained by shifting the start timing of the plate 1 with respect to the timing of movement of the photosensitive drum 9 and the copying sheet, while the starting position of the plate 1 is kept unchanged, to change the exposure timing of the photsensitive drum. It may be also possible to regulate the distance X by controlling the exposure timing to the photosensitive drum by stopping the movement of the drum during the exposure. The direction of image shift may be reversed by regulating the starting position and the starting timing of the illumination device in the opposite directions.

As to the shift in the Y direction orthogonal to the X direction, shown in FIG. 8C, the condenser lens 7 supported shiftably in the Y direction is shifted from a usual position 7' to a position 7 by a distance Y/2. The direction of image shift can be reversed by reversing the direction of lens shift. Alternatively, it may be possible to make the photosensitive drum shiftable in a direction orthogonal to the copy sheet feeding direction.

According to another embodiment of the present invention, the image shift in X and Y directions can be achieved by merely regulating a stopping position of the original sheet.

Figure 12:
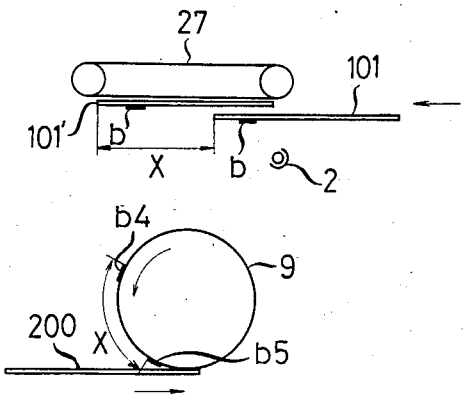
FIGS. 12 and 13 illustrate another shifting of an original image in the copy paper feeding direction.

As to a shift in the X direction using the automatic original sheet feeding device 27 shown in FIGS. 3 and 4, a stopping position of the second original sheet 101 on the original sheet mounting plate 1 is set at a position backwardly of the position of the original sheet 101', whose image b is not shifted, by a distance X, as shown in FIG. 12. Thus, it becomes possible to shift the visible image portion b5 of the original sheet 100 formed on the photosensitive member 9 forwardly of the visible image portion b4 of the original sheet 101' by a distance X and to obtain the visible image as shown in FIG. 8B. The direction of shift can be reversed by reversing the stopping position of the original sheet 101 with respect to the original sheet 101'.

In this embodiment, the automatic original sheet feeding device 27 is used to set the stopping position of the original sheet without the necessity of providing any special means therefor. In this case, when the device 27 employs a belt conveyor as shown, the stopping position can be regulated by controlling an operation time of the belt conveyor. When the device 27 employs rollers (not shown) for feeding the original sheet, it may possible to control an operation time of the rollers. Any other mechanism may be used for this purpose.

Figure 13:
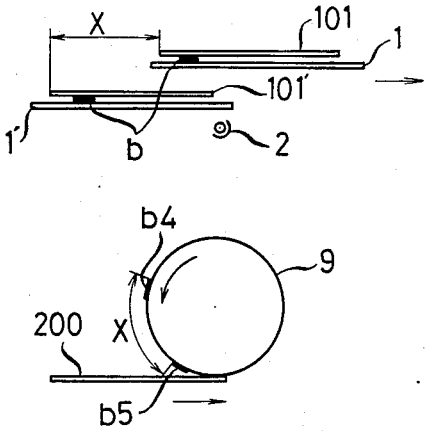

In another embodiment shown in FIG. 13, in which the illumination device 2 is stationary and the original sheet on the original sheet mounting plate is illuminated while the plate is being moved, the original sheet mounting plate 1 on which the original sheet 101 whose image portion b is to be shifted is disposed is moved rightwardly from a position which is forwardly by a distance X of a starting position of the original sheet mounting plate 1' on which the original sheet 101' whose image portion is not shifted is disposed. With this arrangement it is possible as shown in a lower portion FIG. 13 to shift the visible image on the photosensitive member 9 and hence the copy sheet 200, as shown in FIG. 8B, in the same manner as shown in FIG. 12. The direction of shift can be reversed by setting the starting position of the original sheet mounting plate opposite with respect to that of the original sheet mounting plate 1'.

In the embodiment in FIG. 13, it is possible to use the original sheet mounting plate as the original sheet position setting means without the necessity of providing any special means therefor.

In a copying machine in which an original sheet mounting plate is stationary during scanning of the original sheet, it may be possible to support the mounting plate shiftably in an X direction with respect to the machine so that an image of the original sheet can be shifted arbitrarily in the X direction to regulate the copy position.

Figure 14:
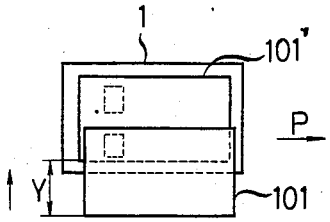
FIG. 14 illustrates another shifting of an original image in the orthogonal direction.

As to the shift in Y direction, when the copying machine is equipped with an automatic original sheet feeding device capable of feeding the original sheet in a Y direction, the stopping position (shown by 101) of the original sheet on the original sheet mounting plate 1 is set forwardly by a distance Y of the usual stopping position (shown by 101') as shown in FIG. 14 in which a letter P depicts a feeding direction of the copy sheet, whereby a copy sheet as shown in FIG. 8C is obtained. In this arrangement, the original sheet feeding device itself can be used as the original sheet position setting means. However, it may be possible to provide means for regulating the stopping position of the original sheet to set the position of the original sheet.

Although not shown, it may be possible to support the original sheet mounting plate shiftably in the Y direction and to change the position of the image by regulating the position of the original sheet on the plate.

In order to shift the original sheet mounting plate by predetermined distances in the X and Y directions by using the arrangement shown in any of FIGS. 12 to 14, a stepping motor or even hand operation may be used. When it is moved by hand, it is effective to provide scales on the mounting plate or the machine so that amounts of movement thereof can be observed by an operator. When the shifting conditions of the mounting plate can be displayed on the display unit 14, it is convenient regardless of the type of operation, hand operation or automatic operation. It is also desirable to display a shift of the illumination device when the latter is shiftable.

Any combination of the shifts in X and Y direction may be selected for an edited composite image to be formed. In this case, by supporting the original sheet mounting plate to be shiftable in both X and Y directions, it is possible to obtain a composite visible image on a copy sheet by merely moving the mounting plate.

Erasure of undesired portion of the second original sheet is performed according to an instruction from the control unit in the same manner as that for the first original sheet.

With such an erasure, a composite copy of the first and second original sheets which is the same as that displayed and edited on the display unit is obtained as shown by the copy 200 in FIG. 5A.

Since the passage changing guide device 23 is switched after the fixing of the composite copy sheet, it is discharged to the discharge tray 22.

A composite copy of more than 2 original sheets may be possible by storing again a copy of a second original sheet in the buffer tray 22 under a switching control of the guide device 23, combining it with a third and subsequent original sheets and finally discharging the composite copy sheet to the discharge tray 22.

A composite edition of the first and second original sheets may be performed by the steps of simulation and copying of the first original sheet which is the same as that described previously, displaying only desired portions of the first and second original sheets which are stored as electric signals on the display unit and fitting these portions in respective frames by shifting the original sheets on the display unit 14 while watching the latter. In this case, it is possible to select the magnification and concentration of the images while watching the display unit.

Since the shifting of desired portion of the second original sheet to an editing position during a copying operation of the second original sheet following the simulation is aheady done by the shifting of the second original sheet, a hard copy which is the same as that edited can be obtained by forming the image on the photosensitive member without performing the controls shown in FIGS. 9 through 14 and transferring it to a copy sheet fed from the buffer tray. Other processings are the same as those in the previously disclosed method.

When a linear array of CCDs is used as the second optical system, it is necessary for reading out an image to move the illumination device enough to scan at least the original sheet. Therefore, when the positional regulation is performed by moving the original sheet by hand while watching the display unit, it is necessary to scan the second original sheet with every movement thereof, otherwise the editing becomes impossible or time-consuming. In order to resolve this problem, the original sheet mounting plate 1 of contact glass is supported shiftable in X and Y directions. The second original sheet is roughly positioned by moving the mounting plate and an image thereon is readout by the CCD array and displayed on the display unit. A deviation of the second original sheet from a desired position is detected on the display unit and then the mounting plate is finely moved in the X and Y directions according to the deviation. According to the fine movement of the mounting plate, the displayed image on the display unit is shifted. With this procedure, the scanning movement of the optical system for the editing positioning can be done at once.

It is possible to form a composite copy by using the copying machine shown in FIGS. 2 to 4 similarly to the machine shown in FIG. 1. The image is readout by the video camera 26 in FIG. 2 or 3 instead of the CCD array 12 in FIG. 1 or by the CCD array 12 in FIG. 4. When the video camera 26 is used, the image on the original sheet can be displayed on a realtime basis and therefore the positioning of the second original sheet by hand is facilitated.

When the magnification of copy is changed, that of the image displayed on the display unit should be changed accordingly. This can be done by changing the magnification of the second optical system 13. Alternatively, it may be possible to change the frame size in which an image can be copied without changing the size of the displayed image.

It is possible to simulate a desired concentration of copy on the image displayed on the display unit. FIG. 7 shows an example of a circuit for performing the latter. If FIG. 7, an original image is readout by the video camera 26, the two-dimensional CCD array or a linear CCD array and is A/D converted according to the concentration thereof and stored in the memory. The digital value stored is compared with a concentration theshold value stored in the micro computer system 53 and image-processed, and then displayed on the display unit 14. The threshold value corresponds to the concentration of the copy image which can be simulated on the display unit 14, and, therefore, it is possible to obtain a copy without error.

The concentration is regulated in the copying machine by changing at least one of the exposure value, the amount of charge and the biasing voltage for development etc.

The display unit can be used for not only the usual display but also various operational displays from the operating portion. It is also usable as a monitor device for indicating a jamming position, a manual display device for operator use and a service-man call content display device for logging function.

The composite copy from a single original sheet such as shown in FIG. 6 can be obtained in the same way as that from plural original sheets. In this case, the image of the single original sheet is repeatedly displayed on the display unit and resultant plural images are edited thereon.

What is claimed is:

1. A method of shifting a copying position of an image on an original sheet to be copied by a copying machine to a desired position on a copy sheet during a copying operation of said copying machine, including illuminating said original sheet by an illuminating device moving relatively thereto to expose a photosensitive member to thereby form an electrostatic laent image thereon, developing said electrostatic latent image with toner and transferring the image onto said copy sheet, said method comprising the step of regulating a position of said image of said original sheet by means of a position setting means in at least one of a copy sheet feeding direction to said photosensitive member and a direction orthogonal to said copy sheet feeding direction to set a visible image forming position on said copy sheet.

2. The method as claimed in claim 1, wherein said regulating step comprises the step of regulating a position of said illumination device at which the latter starts to effectively illuminate said original sheet.

3. The method as claimed in claim 1, wherein said regulating step comprises the step of regulating an exposure timing of said photosensitive member.

4. The method as claimed in claim 1, wherein said regulating step comprises the step of regulating said position of said image in said orthogonal direction by moving a condenser lens in a direction orthogonal to an optical axis thereof.

5. A copying machine for copying desired portions of a single or plural original sheets on desired positions of a single copy sheet, comprising an illumination device for optically scanning said original sheets mounted on an original sheet mounting means, a first optical system including at least one lens for condensing said images of said original sheets obtained by scanning by said illumination device on a photosensitive member, a second optical system including a photoelectric conversion means for converting said images into electric signals, a control unit for processing said electric signals from said second optical system, a display unit for displaying said images on the basis of signals from said control unit and means for selecting areas of the copy sheet on said display unit in which said images are to be reduced, said control unit including means for storing and processing instructions from said selecting means.

6. A copying machine for copying a plurality of original images onto selected positions of a single copy sheet comprising:

an original sheet mounting means;

illumination means for optically scanning at least a portion of an original sheet operatively positioned by said original sheet mounting means;

a photosensitive member;

first optical means for transferring an image scanned from an original sheet by said illumination means and forming a corresponding latent image on a photosensitive member;

developing means for developing a latent image formed on said photosensitive member;

copy sheet feeding means for feeding a copy sheet into contact with said photosensitive member;

transfer means for transferring a developed image from said photosensitive member to a copy sheet fed by said feeding means and fixing the image thereon;

intermediate guide means for guiding a copy sheet onto which a first original image has been transferred by said transfer means onto a first selected position of the copy sheet along a return path to be fed at least a second time by said feeding means into contact with said photosensitive member for transferring a second original image onto a second selected position of the copy sheet;

second optical means including photoelectric conversion means for scanning an image of an original sheet and converting the image into image signals;

display means including a control unit for processing image signals from said second optical means and displaying a corresponding image of an original sheet and an available copy area of a copy sheet;

selecting means for selecting an original image of at least a portion of an original sheet displayed by said display means and a position in said copy area in which the selected original image is to be copied, said selecting means including memory means for storing selection instructions for copying at least first and second selected original images in respective selected copy positions on a copy sheet; and regulating means responsive to said selecting means and comprising means for controlling operation of at least one of said original sheet mounting means, illumination means, first optical means, developing means, copy sheet feeding means, or intermediate guide means such that said at least first and second selected original images are copied onto said selected copy positions on a copy sheet.

7. A copying machine according to claim 6, wherein said regulating means includes switchover means for switching scanning of an original sheet between said first and said second optical means.

8. A copying machine according to claim 6, wherein said regulating means includes means for controlling movement of a movable original sheet mounting means relative to a stationary illumination means for scanning a selected image portion of an original sheet.

9. A copying machine according to claim 6, wherein said regulating means includes means for controlling movement of a movable illumination means relative to a stationary original sheet mounting means for scanning a selected image portion of an original sheet.

10. A copying machine according to claim 6, wherein said regulating means includes means for controlling movement of said photosensitive member relative to said first optical system for forming a latent image on said member of a selected image portion of an original sheet.

11. A copying machine according to claim 6, wherein said regulating means includes means for controlling movement of said first optical system relative to said photosensitive member for forming a latent image on said member of a selected image portion of an original sheet.

12. A copying machine according to claim 6, wherein said regulating means includes means for controlling said copy sheet fedding means for feeding a copy sheet relative to said photosensitive member for forming a latent image on said member of a selected image portion of an original sheet.

13. A copying machine according to claim 6, wherein said regulating means includes means for controlling said photosensitive member relative to a copy sheet fed by said copy feeding means for forming a latent image on said member of a selected image portion of an original sheet.

14. A copying machine according to claim 6, wherein said developing means includes erasing means for erasing a portion of a latent image area on said photosensitive member, and said regulating means includes means for controlling said erasing means for forming a latent image on said member of a selected image portion of an original sheet.

15. A copying machine according to claim 6, wherein said regulating means controls movement of at least one of said means relative to an X direction parallel to the direction of feeding a copy sheet.

16. A copying machine according to claim 6, wherein said regulating means controls movement of at least one of said means relative to a Y direction orthogonal to the direction of feeding a copy sheet.

17. A copying machine according to claim 6, wherein said first optical system includes magnification means and said selecting means includes means for selecting a magnification level of a selected original image to be copied on a copy sheet.

18. A copying machine according to claim 6, wherein said developing means includes development concentration means and said selecting means includes means for selecting a concentration level of a selected original image to be copied on a copy sheet.

19. A copying machine according to claim 6, wherein said selected optical means includes a video camera.

20. A copying machine according to claim 6, wherein said selected optical means includes a charge coupled device.

* * * * *